US005563416A

United States Patent [19]

Hatakeyama

[11] Patent Number: 5,563,416

[45] Date of Patent: Oct. 8, 1996

[54] PROCESSING APPARATUS USING FAST ATOM BEAM

[75] Inventor: Masahiro Hatakeyama, Kanagawa-ken, Japan

[73] Assignee: Ebara Corporation, Tokyo, Japan

[21] Appl. No.: 267,741

[22] Filed: Jul. 5, 1994

[30] Foreign Application Priority Data

Jul. 5, 1993 [JP] Japan ..... 5-192073

[51] Int. Cl.[6] ..... H05H 3/00

[52] U.S. Cl. ..... 250/492.1; 250/251; 156/643.1

[58] Field of Search ..... 250/492.1, 251; 156/643

[56] References Cited

U.S. PATENT DOCUMENTS

| | | | |
|---|---|---|---|
| 4,624,736 | 11/1986 | Gee et al. | 156/643 |
| 4,874,459 | 10/1989 | Coldren et al. | 156/643 |
| 4,886,570 | 12/1989 | Davis et al. | 156/643 |
| 5,108,543 | 4/1992 | Suzuki et al. | 156/643 |
| 5,108,778 | 4/1992 | Suzuki et al. | 427/38 |
| 5,286,331 | 2/1994 | Chen et al. | 156/345 |
| 5,429,730 | 7/1995 | Nakamura et al. | 250/492.1 |

FOREIGN PATENT DOCUMENTS

| | | |
|---|---|---|
| 0380667 | 8/1990 | European Pat. Off. . |
| 0418540 | 3/1991 | European Pat. Off. . |
| 0502429 | 9/1992 | European Pat. Off. . |
| 2555829 | 5/1985 | France . |
| 5-331623 | 12/1993 | Japan . |
| 886044 | 11/1981 | United Kingdom . |

OTHER PUBLICATIONS

Thin Solid Films, vol. 202, No. 2, 30 Jul. 1991, Lausanne CH pp. 315–320, Xi Wang et al. "Synthesis of Titanium Nitride Films By Ion–Beam–Enhanced–Deposition".

Journal of Vacuum Science and Technology: Part B, vol. 9, No. 2/1, Mar. 1991, New York, U.S., pp. 197–207, Winters et al., "Etching Reactions for Silicon with Fatoms: Product Distributions and Ion Enhancement Mechanisms".

J. Appl. Phys, Sep. 1989, Shimokawa et al., 66:2613–2618, *Reactive–fast–atom beam etching GaAs using $Cl_2$ gas.*

*Primary Examiner*—Bruce C. Anderson

*Attorney, Agent, or Firm*—Armstrong, Westerman, Hattori, McLeland & Naughton

[57] ABSTRACT

A processing apparatus using a fast atom beam which has at least one source selected from among a light energy source, a laser beam source, a radical source, an electron beam source, an X-ray or radiation (alpha rays, beta rays, or gamma rays) source, and an ion source, in addition to the fast atom beam source, so that an object to be processed which is disposed in a vacuum container or outside a vacuum is irradiated with a fast atom beam in combination with at least one selected from among the light energy, laser beam, electron beam, X-rays or radiation, radical particles and ion beam, to thereby increase processing speed.

8 Claims, 3 Drawing Sheets

PROCESSING APPARATUS USING FAST ATOM BEAM

BACKGROUND OF THE INVENTION

1. Field of the Art

The present invention relates to a processing apparatus which is designed to process an object by jointly employing irradiation with a fast atom beam of atoms or molecules having a relatively large kinetic energy and irradiation with light energy, radical particles, ion beam, laser beam, X-rays etc.

2. Prior Art

FIG. 3 is a conceptual view showing a conventional processing apparatus that uses a fast atom beam. As illustrated in the figure, the conventional processing apparatus has a vacuum container 2 and a fast atom beam source 1 that releases a fast atom beam 3 into the vacuum container 2 so that the fast atom beam 3 is applied to an object 4 to be processed which is placed on a rotary table 5 disposed in the vacuum container 2. The vacuum container 2 has been evacuated by a turbo-molecular pump 7 or the like.

In the processing apparatus having the above-described arrangement, a gas which is highly reactive with the object 4 to be processed is generally used as a gas 6 for the fast atom beam 3 in order to increase the processing speed. For example, chlorine gas is used for processing GaAs. In addition, with a view to achieving uniform processing, the object 4 is irradiated with the fast atom beam 3 with the rotary table 5 being rotated.

Advantageous features of the processing method using a fast atom beam are as follows:

1) the directivity of the fast atom beam is excellent;
2) it is possible to carry out processing under high-vacuum conditions and, thus, collision rate between the fast atom beam and other particles is low and precise processing is possible; and
3) since non-charged particle rays are used, it is possible to process not only an electrically conductive material but also an insulating material, which cannot effectively be processed by an ion beam.

However, the above-described conventional processing apparatus using a fast atom beam suffers from the problem that since the quantity of radical particles or ion particles adsorbed on the surface of the object to be processed is small in comparison to the plasma processing technique, the processing speed is disadvantageously low.

SUMMARY OF THE INVENTION

In view of the above, it is an object of the present invention to provide a processing apparatus using a fast atom beam, which is capable of high-speed and efficient processing.

To solve the above-described problems, the present invention provides a processing apparatus having at least one source selected from among a light energy source, a laser beam source, a radical source, an electron beam source, an X-ray or radiation (alpha rays, beta rays, or gamma rays) source, and an ion source, in addition to a fast atom beam source, so that an object to be processed which is disposed in a vacuum container or outside a vacuum is irradiated with a fast atom beam in combination with at least one selected from among the light energy, laser beam, electron beam, X-rays or radiation, radical particles and ion particles, thereby processing the object.

Atoms and molecules that create thermal motion in the atmosphere at ordinary room temperature generally have a kinetic energy of about 0.05 eV. Atoms and molecules having a much larger kinetic energy than the above are generally called "fast atoms", and when a group of such fast atoms flow in the form of a beam in one direction, it is called "fast atom beam". Since the fast atom beam is electrically neutral, a processing technique employing such a fast atom beam can be applied not only to metals and semiconductors but also to insulators such as plastics, ceramics, etc., to which the processing technique that uses charged particles cannot effectively be applied.

With the above-described arrangement of the present invention, the object is processed by irradiation with the fast atom beam in combination with at least one selected from among light energy, laser beam, electron beam, X-rays or radiation, radical particles and ion particles. Accordingly, the quantity of radical particles or ion radical particles adsorbed on the surface of the object are increased, so that the processing can be efficiently effected at high speed.

Namely, when irradiated with radical particles or ion beams, chemical reactive particles are increased on the surface of the object which increases the processing speed.

When irradiated with a light energy, laser beam, X-ray or radiation, chemical reactive particles are activated on the surface of the object thereby creating radicals or ions which increase the processing speed. In addition, when irradiated with a light energy, laser beam, X-ray or radiation, atoms in the surface layer of the object are activated which assists processing by the fast atom beam and radicals. In particular, when relatively high energy irradiation such as an X-ray or radiation is combined with the irradiation of the fast atom beam, then atoms in the surface layer in the object to be processed are activated and the atomic bonding is weakened or loosened which assists processing by the fast atom beam and the radicals or ions.

Further, the chemical processing by the radicals or ions assists the physical processing by the fast atom beam having excellent directivity which enables precise processing in the depthwise direction of the patterned hole.

Further, when an electron beam or laser beam is used, it enables a local processing of the object which makes figure control of the product easy.

The above and other objects, features and advantages of the present invention will become more apparent from the following description when taken in conjunction with the accompanying drawings in which preferred embodiments of the present invention are shown by way of illustrative examples.

PREFERRED EMBODIMENTS OF THE INVENTION

Figure 1:
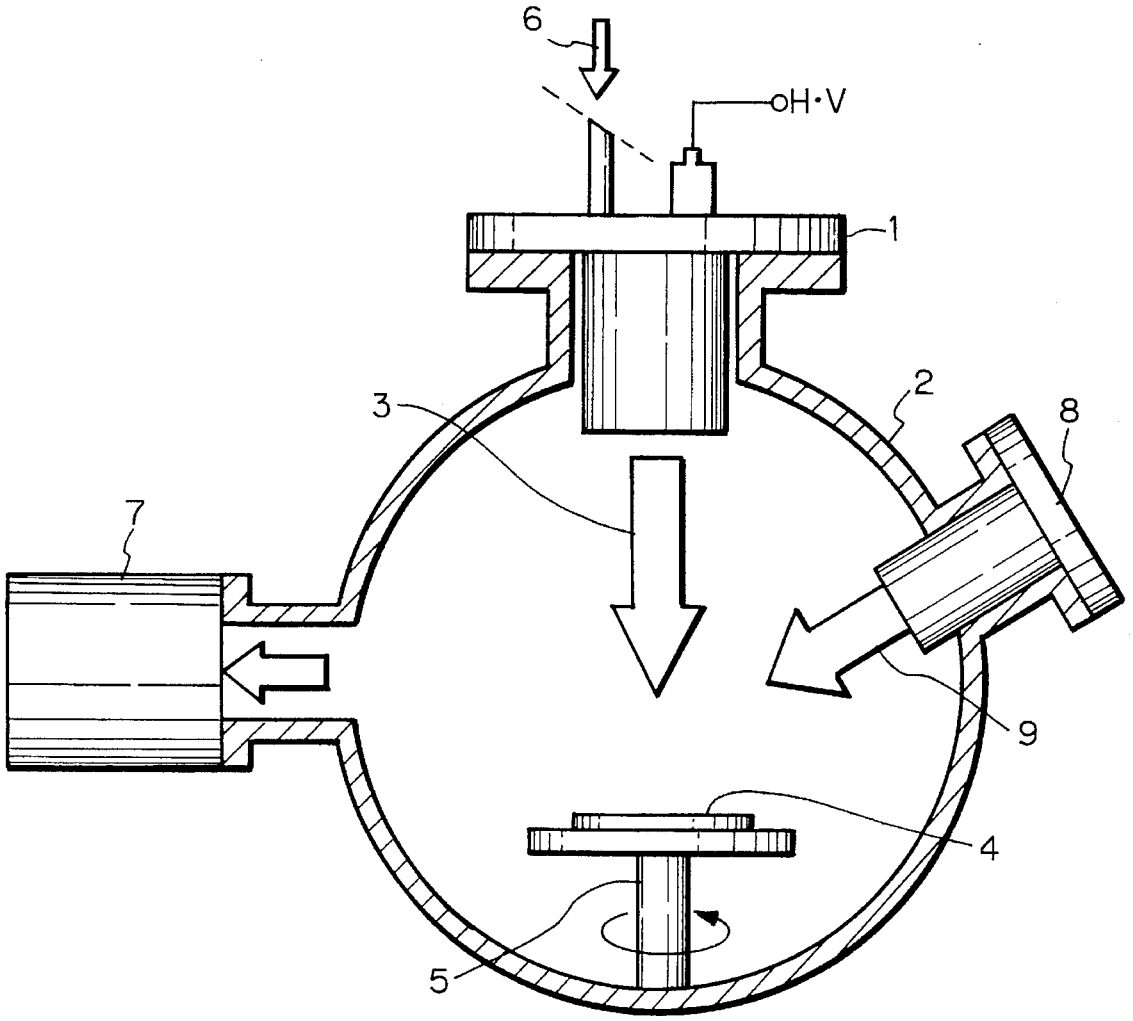
FIG. 1 schematically shows an arrangement of the processing apparatus using a fast atom beam according to the present invention, FIG. 2 schematically shows another arrangement of the processing apparatus using a fast atom beam according to the present invention, and FIG. 3 schematically shows the arrangement of a conventional processing apparatus that uses a fast atom beam.
Figure 3:
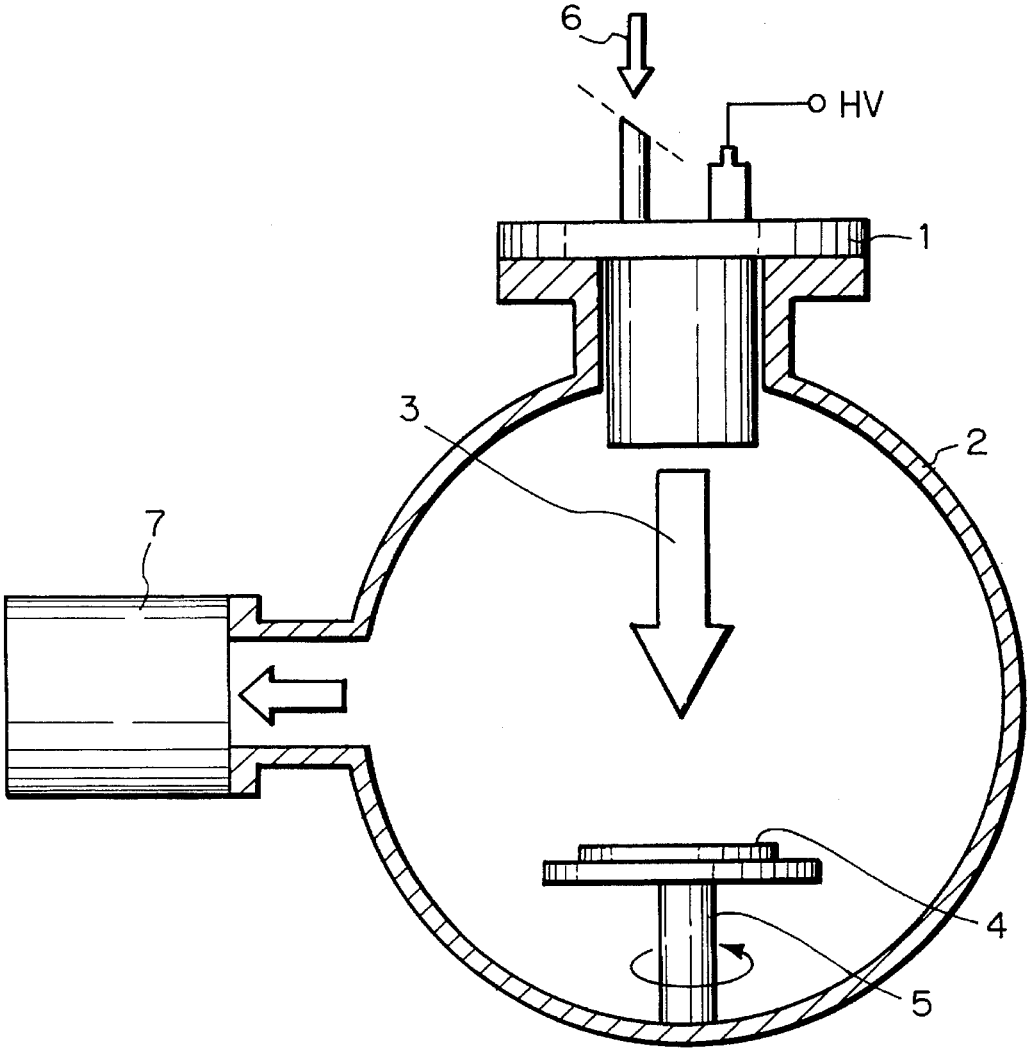

Embodiments of the present invention will be described below with reference to the accompanying drawings. FIG. 1 schematically shows an arrangement of the processing apparatus using a fast atom beam according to the present invention. In the figure, the same reference numerals as those in FIG. 3 denote the same or equivalent portions. The same is the case with the other drawing.

Referring to FIG. 1, the fast atom beam 3 is released into the vacuum container 2 from the fast atom beam source 1, and the fast atom beam 3 is applied to the surface of the object 4 to be processed which is placed on the rotary table 5. The fast atom beam source 1 could be a conventional one such as described in U.S. Pat. No. 5,216,241 issued to Hatakeyama et al.

Such a fast atom beam source may include a chemical reactive gas or inert gas as a discharge gas. The vacuum container 2 has been evacuated by the turbo-molecular pump 7 or the like. The rotary tale 5 is rotating so that the object 4 is uniformly processed.

In order to enhance the chemical reactivity at the object surface and to thereby increase the processing speed, a radical source 8 such as RF discharge radical source is provided to supply radical particles 9 to the surface of the object 4 to be processed. It should be noted that the processing speed can be further increased by adsorbing ions of low energy, which are higher in reactivity than radical particles, on the surface of the object 4 to be processed in the arrangement shown in FIG. 1. In this case, the radical source 8 is replaced with a ion beam source. When the radical source or the ion beam source is used, chemical reactive particles are directly increased which increases the processing speed. Also, the chemical processing by the radicals and ions assists the physical processing by the fast atom beam having excellent directivity which enables precise processing in the depthwise direction of the patterned hole.

Figure 2:
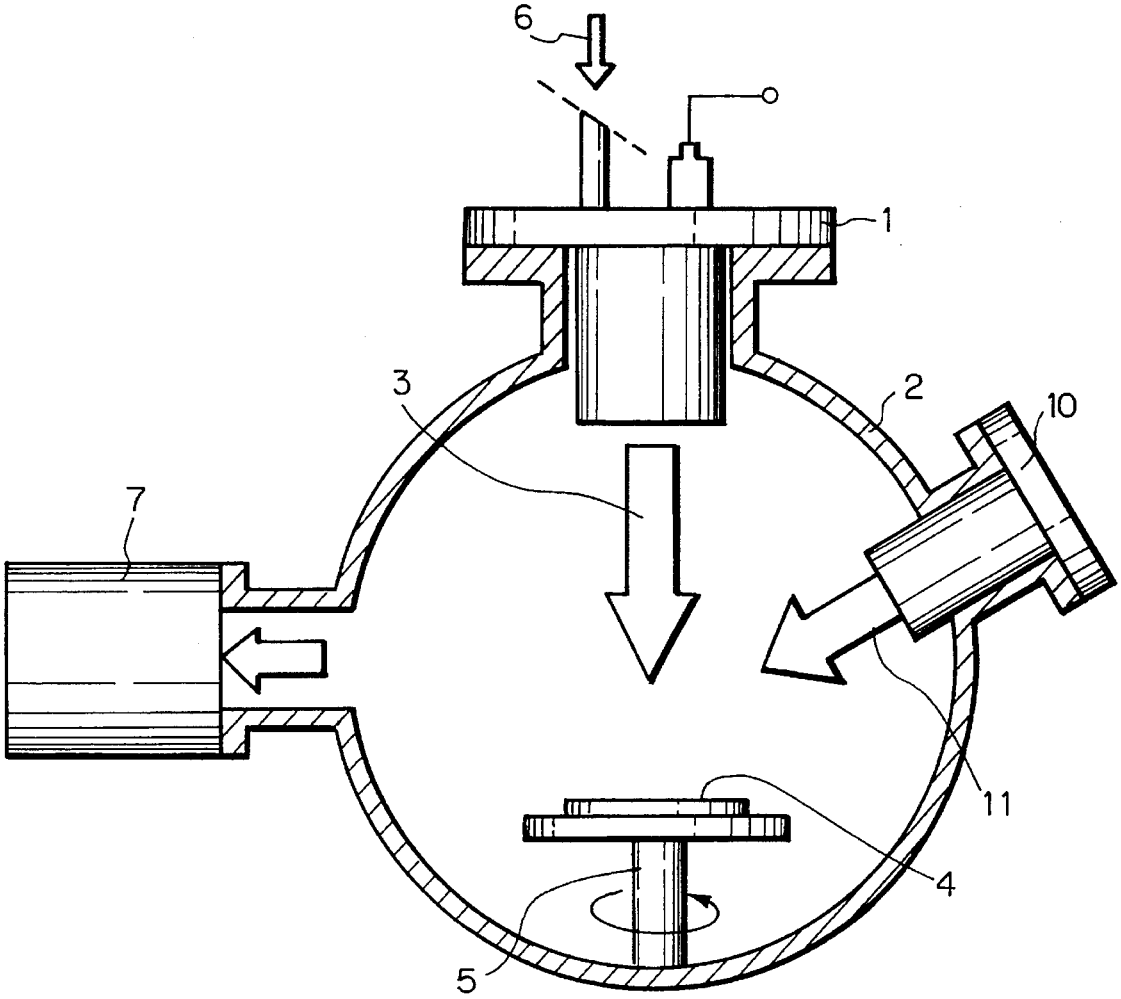

FIG. 2 schematically shows another arrangement of the processing apparatus using a fast atom beam according to the present invention. In the processing apparatus shown in FIG. 2, the surface of the object 4 to be processed is irradiated with light energy 11 emitted from a light energy source 10 such as a heavy hydrogen lamp in order to activate the particles adsorbed on the surface of the object 4 to thereby enhance the chemical reaction and increase the processing speed. The light energy source 10 emits light including a wavelength in the absorption wavelength band of the particles adsorbed on the surface of the object 4. A laser beam having excellent absorption wavelength selectivity may be used in place of the light energy. When the light energy or laser beam is used, the particles adsorbed on the surface of the object are activated which creates radicals or ions for increasing the processing speed. Also, the irradiation by this light energy or laser beam activates the atoms in the surface layer of the object which assists processing by the fast atom beam and radicals or ions.

With a view to not only activating the particles adsorbed on the surface of the object 4 to be processed so as to raise the reaction rate and to thereby increase the processing speed but also separating the atoms constituting the object 4 or loosening the atomic bond, an X-ray source or a radiation source which emits X-rays or a radiation (alpha rays, beta rays, or gamma rays), which is higher in energy than light energy, may be provided in place of the light energy source 10 to irradiate the surface of the object 4 to be processed with the X-rays or radiation from the X-ray or radiation source, thereby making it possible to increase the processing speed.

The fast atom beam 3 stated above may be formed as follows: Ions which are present in a plasma generated in the electric discharge area in the fast atom beam source 1 are accelerated by an electric field, and the accelerated ions perform charge exchange in the atom emitting holes in an electrode installed at the exit side of the fast atom beam source 1 and are released in the form of the fast atom beam 3. If it is intended to obtain a fast atom beam 3 of a high neutralization rate, the proportion of collision of radical particles which are produced by the electric discharge with the residual gas particles or the wall surfaces of the atom emitting holes increases, so that the produced radical particles are deactivated, resulting in a reduction in the quantity of radical particles adsorbed on the surface of the object 4 to be processed. Accordingly, the processing method is inferior in processing speed to the processing technique that is carried out in a plasma.

In the above-described embodiments, the surface of the object 4 to be processed is supplied with the radical particles 9 or the light energy 11 to activate the adsorbed particles in order to increase the processing speed even in a case where a fast atom beam of high neutralization rate is used. For example, when chlorine gas is used as the gas 6 supplied to the fast atom beam source 1 and the object 4 to be processed is GaAs, the supply of the radical particles 9 makes it possible to obtain a processing speed at least double the processing speed of the processing that uses only the fast atom beam 3. When $SF_6$ gas is used as the gas 6 and the object 4 to be processed is Si, if the surface of Si as the object 4 is irradiated with ultraviolet light from a deuterium lamp used as the light energy source 10, it is possible to obtain a processing speed at least ten times the processing speed of the processing that uses only the fast atom beam 3.

It is also possible to provide an electron beam source for releasing electron beam in place of the light energy source 10 in FIG. 2 so that the surface of the object 4 to be processed is irradiated with the electron beam from the electron ray source.

Further, the light energy source 10 in FIG. 2 may be replaced with a combination of at least two sources selected from among a light energy source for releasing light energy into the vacuum container, a laser beam source for releasing laser beam into the vacuum container, an electron beam source for releasing electron beam into the vacuum container, an X-ray source for releasing X-rays into the vacuum container, a radiation source for releasing radiation into the vacuum container, radical source for releasing radical particles into the vacuum container, and an ion source for releasing ion particles into the vacuum container so that the surface of the object 4 to be processed is irradiated with a combination of at least two selected from among the light energy, laser beam, electron beam, X-rays, radiation, radical particles and ion particles released from the corresponding sources.

Although in the foregoing embodiments the vacuum container 2 is used and the surface of the object 4 placed in a vacuum is irradiated with the fast atom beam and light energy, radical particles, etc., the arrangement may be such that no vacuum container 2 is used, but the surface of the object 4 which is disposed outside a vacuum is irradiated with the fast atom beam and light energy, radical particles, etc.

With the conventional processing method that uses only a fast atom beam, a high processing speed cannot be expected because as the neutralization rate is increased, the quantity of radical particles or ion particles adsorbed on the surface or the object to be processed decreases. According to the present invention, however, a fast atom beam and radical particles, light energy, laser beam, etc. are jointly used, and it is therefore possible not only to increase the processing speed but also to control the fast atom beam and the quantity of radical particles adsorbed on the object surface independently of each other. Accordingly, it becomes possible to improve the controllability for the configuration formed by processing and the processing speed.

What is claimed is:

1. A processing apparatus comprising a vacuum container, a fast atom beam source for releasing into said vacuum container a fast atom beam of atoms having a relatively large kinetic energy, and a light energy source for releasing light energy into said vacuum container, wherein a surface of an object to be processed which is disposed in said vacuum container is irradiated with the fast atom beam and the light energy from respective said fast atom beam source and said light energy source, thereby processing said object.

2. A processing apparatus comprising a vacuum container, a fast atom beam source for releasing said vacuum container a fast atom beam of atoms having a relatively large kinetic energy, and a laser beam source for releasing laser beam into said vacuum container, wherein a surface of an object to be processed which is disposed in said vacuum container is irradiated with the fast atom beam and the laser beam from respective said fast atom beam source and said laser beam source, thereby processing said object.

3. A processing apparatus comprising a vacuum container, a fast atom beam source for releasing into said vacuum container a fast atom beam of atoms having a relatively large kinetic energy, and a radical source for releasing radical particles into said vacuum container, wherein a surface of an object to be processed which is disposed in said vacuum container is irradiated with the fast atom beam and the radical particles from respective said fast atom beam source and said radical source, thereby processing said object.

4. A processing apparatus comprising a vacuum container, a fast atom beam source for releasing into said vacuum container a fast atom beam of atoms having a relatively large kinetic energy, and an electron beam source for releasing the electron beam into said vacuum container, wherein a surface of an object to be processed which is disposed in said vacuum container is irradiated with the fast atom beam and the electron beam from respective said fast atom beam source and said electron beam source, thereby processing said object.

5. A processing apparatus comprising a vacuum container, a fast atom beam source for releasing into said vacuum container a fast atom beam of atoms having a relatively large kinetic energy, and an X-ray source for releasing X-rays into said vacuum container, or a radiation source for releasing a radiation into said vacuum container, wherein an object to be processed which is disposed in said vacuum container is irradiated with the fast atom beam and the X-rays or radiation from respective said fast atom beam source and said X-ray or radiation source, thereby processing said object.

6. A processing apparatus comprising a vacuum container, a fast atom beam source for releasing into said vacuum container a fast atom beam of atoms having a relatively large kinetic energy, and an ion source for releasing ion beam into said vacuum container, wherein an object to be processed which is disposed in said vacuum container is irradiated with the fast atom beam and the ion beam from respective said fast atom beam source and said ion source, thereby processing said object.

7. A processing apparatus comprising a vacuum container, a combination of at least two sources selected from among a light energy source for releasing light energy into said vacuum container, a laser beam source for releasing laser beam into said vacuum container, an electron beam source for releasing electron beam into said vacuum container, an X-ray source for releasing X-rays into said vacuum container, a radiation source for releasing radiation (alpha rays, beta rays, or gamma rays) into said vacuum container, a radical source for releasing radical particles into said vacuum container and an ion source for releasing ion particles into said vacuum container, and a fast atom beam source for releasing into said vacuum container a fast atom beam of atoms that having a relatively large kinetic energy, wherein an object to be processed which is disposed in said vacuum container is irradiated with a combination of at least two selected from among the light energy, laser beam, electron beam, X-rays, radiation, radical particles, and ion particles released from the corresponding sources and said FIB source, thereby processing said object.

8. The processing apparatus of any one of claims 1 to 7 wherein said fast atom beam source includes a chemical reactive gas or inert gas as a discharge gas.

* * * * *